US007682299B2

(12) United States Patent
Veciana Membrado

(10) Patent No.: US 7,682,299 B2
(45) Date of Patent: Mar. 23, 2010

(54) PROCEDURE FOR PRODUCTION OF CONICAL ICE CREAM WRAPPERS

(75) Inventor: Josep Ma Veciana Membrado, Reus (ES)

(73) Assignee: Big Drum, S.L., Tarragona (ES)

( * ) Notice: Subject to any disclaimer, the term of this patent is extended or adjusted under 35 U.S.C. 154(b) by 255 days.

(21) Appl. No.: 11/757,721

(22) Filed: Jun. 4, 2007

(65) Prior Publication Data

US 2007/0281845 A1 Dec. 6, 2007

(30) Foreign Application Priority Data

Jun. 5, 2006 (ES) ..... 200601503

(51) Int. Cl.
*B31B 1/14* (2006.01)
*B65D 75/02* (2006.01)

(52) U.S. Cl. ..... 493/83; 493/152; 493/363; 229/87.08

(58) Field of Classification Search ..... 493/155, 493/152, 56, 83, 361, 363; 426/138, 143; 229/87.01, 87.05, 87.07, 400
See application file for complete search history.

(56) References Cited

U.S. PATENT DOCUMENTS 2,056,636 A * 10/1936 Whilting, Jr. ..... 156/189
2,139,614 A * 12/1938 Amberg ..... 493/65
2,187,769 A 1/1940 Carew
2,194,275 A 3/1940 Carew
2,197,782 A * 4/1940 Barbieri ..... 493/74
2,200,512 A * 5/1940 Merta ..... 493/155
2,224,129 A * 12/1940 Amberg ..... 493/155
2,272,308 A 2/1942 Merta
2,303,352 A * 12/1942 Goldberg ..... 53/399
3,041,802 A * 7/1962 Cummings et al. ..... 53/479
3,065,676 A * 11/1962 Loeser et al. ..... 493/155
3,391,617 A * 7/1968 Wise et al. ..... 493/62
3,710,931 A * 1/1973 Hollinger ..... 206/497
4,530,201 A * 7/1985 Carlsson ..... 53/397
4,838,431 A * 6/1989 Sanz et al. ..... 229/246
4,932,932 A 6/1990 Schmidt et al.
D369,540 S * 5/1996 Weder et al. ..... D9/629
7,093,390 B2 * 8/2006 Cheng ..... 47/41.01
2005/0040214 A1 * 2/2005 Veciana I Membrado 229/87.05
2006/0157544 A1 * 7/2006 Chomic et al. ..... 229/4.5

FOREIGN PATENT DOCUMENTS

DE 1023962 B 2/1958

* cited by examiner

*Primary Examiner*—Paul R Durand
(74) *Attorney, Agent, or Firm*—Sughrue Mion, PLLC

(57) ABSTRACT

This is a continuous mode procedure wherein in a first cutting operation an upper band (5) is obtained and a lower band (6), followed by a second cutting operation to obtain some separate trapezoidal segments (4), to finish with a third cutting operation on the curled side (10) of the segment (4) to obtain a circular side with only one radius of curvature, forming in this way a wrapper (11) of conical development.

6 Claims, 3 Drawing Sheets

PROCEDURE FOR PRODUCTION OF CONICAL ICE CREAM WRAPPERS

OBJECT OF THE INVENTION

The present invention is of application for the production of ice cream wrappers.

The object of the invention consists in the optimization of this production process with the purpose of minimizing the size of the disposable trimmings which are obtained after the stamping of the paper roil on which the wrappers are printed.

It is a further object of the invention that this production process takes place in continuous mode in order to reduce the times for obtaining the conical wrappers and the manipulation involved.

BACKGROUND OF THE INVENTION

At the present time the production of conical wrappers in aluminum paper is carried out by a discontinuous system by means of which some superimposed sheets are stamped, and a series of segments are obtained which are then stacked prior to being sent to the cone-forming machine.

On these segments the prints that will later be stamped to define the wrappers have been carried out beforehand. These segments usually appear separate from each other defining an indented space between them.

Once the different segments have been stamped, the separating spaces between the same constitute disposable pieces of paper. The accumulation of these disposable pieces signifies a substantial paper loss and accumulation of waste.

The stamped segments are obtained with different orientations and require being stacked manually for their later continual feeding into the cone-forming machine.

Another possible solution for producing wrappers in discontinuous mode envisages the incorporation of a paper roll in which a series of separate printed segments appear, this paper is unwound passing through a stamping machine in which the segments are cut and which subsequently are stacked and pass to a cone-forming machine. The rest of the paper constitutes trim which is gathered on a roll.

The employment of paper rolls with the segments already printed is problematical due to the curling that takes place with the paper due to the effects of humidity and temperature. This dimensional variation greatly complicates the winding operation and can finally render it impossible in the most extreme cases, thereby determining an undesired outcome that requires the process to be stopped.

The operation of stamping in discontinuous mode to obtain ice cream wrappers therefore has a series of drawbacks which make the development of an alternative solution feasible

DESCRIPTION OF THE INVENTION

The production procedure of conical ice cream wrappers which this invention discloses consists of a system in continuous mode wherein the segments, printed or to be printed, from which the wrappers are obtained, appear distributed on a supporting sheet preferably wound in a roll, from which the supporting sheet is extended to proceed to the cutting of each of these segments in accordance with some cutting lines and a sequence until the conical wrapper is obtained.

In a first cutting stage on the supporting sheet supplied in continuous mode some curled cutting lines are made and centered followed by some oblique cutting lines which divide the supporting sheet into an upper band and a tower band.

The upper and lower bands so defined can be rewound for their storage and later use, or they are directed toward the cone-forming machine.

Next a series of cuts are made on the upper and lower band respectively, more specifically some oblique cutting lines contiguous with the previous lines, and in this way obtain some separate segments.

These segments have an essentially trapezoidal configuration, in which each of them has two parallel sides of different length (longer side and shorter side), an inclined side and a curled side.

In another cutting operation carried out subsequently or at the same time as the previous one, a cut is made in the curled side, more specifically it concerns transforming the curled side into a curved side with a single radius of curvature, for which reason a cut is made from the point of inflection of this side following the same curvature to the vertex defined between the inclined side and the shorter parallel side.

The surplus piece is of reduced size and has an essentially triangular configuration with circular base.

This way a wrapper of conical development is defined, which when folded in the one-forming machine adopts the conical configuration of a wrapper for ice creams.

In a preferred manner, it is envisaged that the supporting sheet stored on the roll is not printed or has some preprint, thereafter when the supporting sheet is unwound from the roll, it is possible to print thereon defining printed segments which are cut thereafter in accordance with the stages described.

In the event of using the wound supporting sheet with the segments already printed, the employment is envisaged of means for positional control which correct possible positional misalignments of the printed segment, confronting the printed segment with the stamping machine and so carrying out the cut in the precise place.

Complementarily it is envisaged that the size of the printed segment is slightly greater than the size of the piece that is finally stamped thus avoiding small misalignments which could result in pieces with sections without printing.

It is envisaged that the supporting sheet (1) is constituted by several layers of materials selected among, paper and aluminum composite, paper and plastic composite, different types of plastic and paper, aluminum or plastic only.

DESCRIPTION OF THE DRAWINGS

To complete the description that is being made and with the object of assisting in a better understanding of the characteristics of the invention, and in accordance with a preferred example of practical embodiment thereof, the same is accompanied, as an integral part of said description, with a set of drawings wherein by way of illustration and not restrictively, the following has been represented.

PREFERRED EMBODIMENT OF THE INVENTION

In the light of the preceding figures a preferred made of embodiment is described hereunder of the procedure for production of conical wrappers which constitutes the object of this invention.

Figure 1:
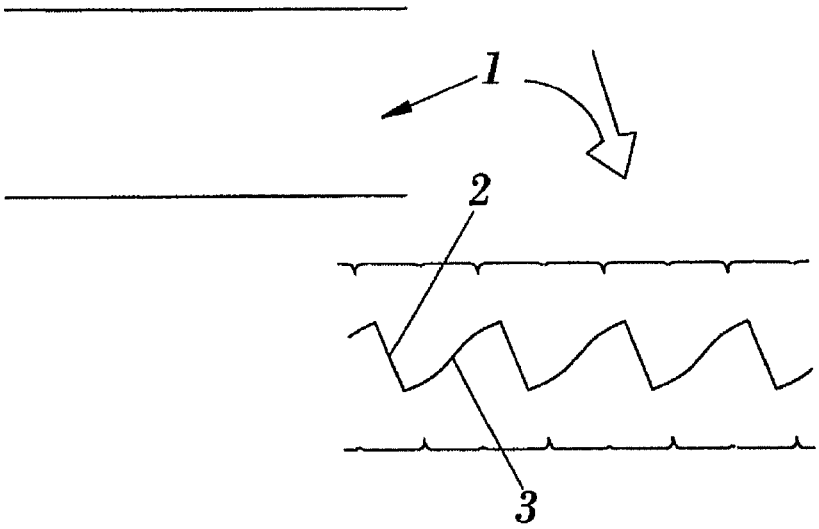
FIG. 1. It shows a plan view in which the first cutting made on the supporting sheet is observed.

In FIG. 1 the supporting sheet (1) is observed based on which the wrappers (11) of conical development will be obtained, in accordance with a procedure in continuous mode.

Figure 2:
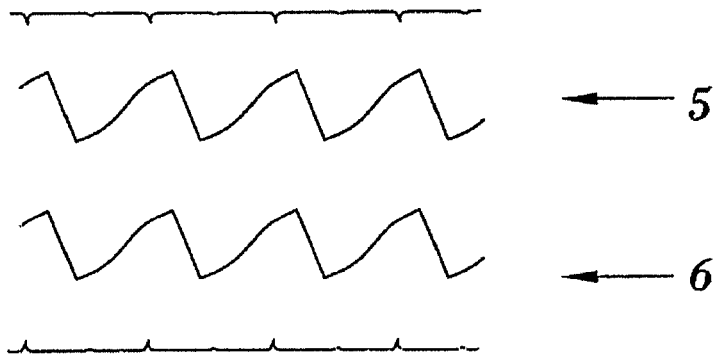
FIG. 2. It shows a plan view in which the upper and lower segment bands are observed, obtained after carrying out the first cutting operation on the supporting sheet.

Beginning with a supporting sheet (1) on which a first cutting operation is carried out, according to FIG. 1, practicing thereafter some first parallel and oblique cutting lines (2) followed by some curled cutting lines (3) in order to obtain an upper band (5) and a lower band (6), such as one observes in FIG. 2.

Figure 3:
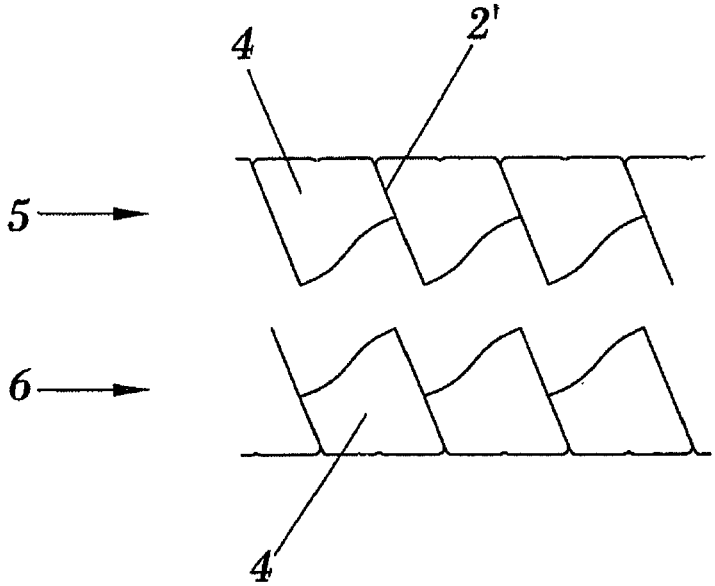
FIG. 3. It shows a plan view in which the practiced cutting lines are appreciated in a second cutting operation performed on the upper or lower bands.
Figure 4:
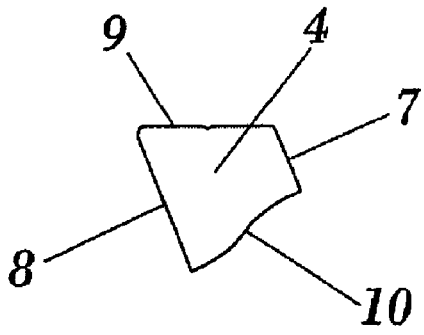
FIG. 4. It shows a plan View of the segment obtained from the second cutting operation.

Next a second cutting operation is carried out on the upper band (5) and on the lower band (6) through some second oblique cutting lines (2') practiced after the first oblique cutting lines (2), as can be seen in FIG. 3 in order to obtain a series of segments (4) of similar dimensions and shape, already separate, as have been represented in FIG. 4, of essentially trapezoidal configuration, configured by a shorter side (7) and a longer side (8) in parallel, an inclined side (9) and a curled side (10) opposite the inclined side (9).

Figure 5:
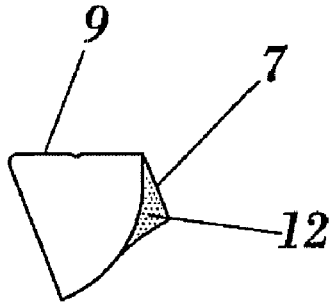
FIG. 5. It shows a plan view in which the third cutting operation is observed carried out on each of said segments in which a corner piece is cut from the segment in order to obtain the wrapper of conical development.
Figure 6:
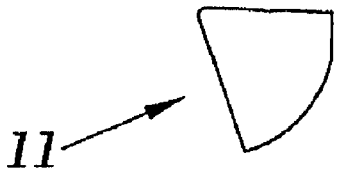
FIG. 6. It shows a plan view of the finally obtained wrapper of conical development.

In FIG. 5 a third cutting operation is observed consisting in performing a cut in the curled side (10) of the segment (4) from its point of inflection to the vertex defined between the inclined side (9) and the shorter side (7), in order to transform the curled side (10) into a circular side having only one radius of curvature, thereby conforming the wrapper (11) of conical development represented in FIG. 6. As a consequence of the cut a corner piece (12) is discarded.

This wrapper (11) has been obtained in a preferred manner according to a procedure in continuous mode and Is fed directly to the cone-forming machine in which the wrapper is folded to obtain the conical configuration in which the ice cream is wrapped.

Figure 7:
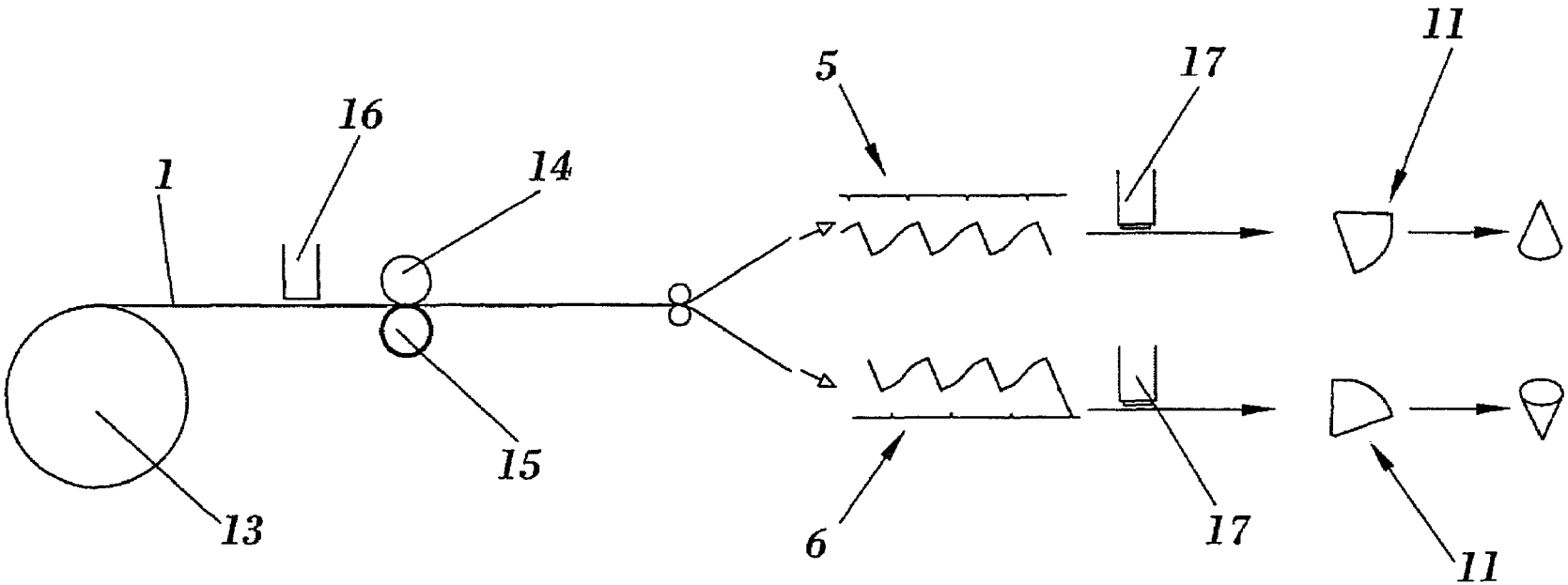
FIG. 7. It shows a schematic View of the facility used to carry out the procedure of the invention.

In FIG. 7 the continuous-mode process is shown for production of conical ice cream wrappers for the case in which the supporting sheet (1) is on a roll (13) from which it is unwound. Prior to carrying out the first cutting, by means of a cutter roller (14) which is represented facing a rubber roller (15), the printing is carried out on the supporting sheet (1) by means of a printing head (16).

After the first cut the second and third cut is made of each of the upper (5) and lower (6) bands by means of cutting heads (17), which can form part of the cone-forming machine in order to finally obtain the wrapper (11) of conical development which is folded in said cone-forming machine to produce the conical form represented.

The invention claimed is:

1. A method of producing conical ice cream wrappers, the method comprising:

a first cutting operation performed on a supporting sheet initially stored on a roll, comprising successively cutting first parallel and oblique cutting lines and cutting curled cutting lines, thereby obtaining an upper band and a lower band, a second cutting operation, performed on both the upper band and on the lower band, comprising cutting second oblique cutting lines extending the first oblique cutting lines, thus obtaining, from each of the upper band and the lower band, a plurality of separate segments of similar dimensions and shape, wherein each of the plurality of separate segments has a shorter sides, a longer side, an inclined side and a curled side, wherein the longer side is parallel to the shorter side, and wherein the curled side is opposite the inclined side, a third cutting operation comprising cutting the curled side of the plurality of segments from a point of inflection to a vertex defined between the inclined side and the shorter side, thus transforming the curled side into a circular side with only one radius of curvature, thereby creating a wrapper having a conical unrolled shape.

2. The method of producing conical ice cream wrappers according to claim 1 wherein, after the first cutting operations the upper band and the lower band are stored on rolls prior to the second and third cutting operations.

3. The method of producing conical ice cream wrappers according to claim 1 wherein the second and third cutting operations are carried out at the same time.

4. The method of producing conical ice cream wrappers according to claim 1 wherein the supporting sheet is unwound from the roll and printed prior to the first cutting operation.

5. The method of producing conical ice cream wrappers according to claim 1 wherein the supporting sheet stored on the roll is printed and a positional correction is made to the supporting sheet prior to the first cutting operation.

6. The method of producing conical ice cream wrappers according to one of claims 1, 4 and 5 wherein the supporting sheet comprises a plurality of layers of one or more materials selected from a paper and aluminum composite, a paper and plastic composite, plastic, paper, and aluminum.

* * * * *